US005317821A

United States Patent [19]

Vargo

[11] Patent Number: 5,317,821

[45] Date of Patent: Jun. 7, 1994

[54] METHOD FOR CUSTOM-FITTING BOOTS BY PROVIDING ATTACHMENTS THERETO OR TO AN INNER LINER THEREFOR

[76] Inventor: Garry B. Vargo, 707 Old Post Rd., Edison, N.J. 08817

[21] Appl. No.: 985,745

[22] Filed: Dec. 4, 1992

Related U.S. Application Data

[63] Continuation of Ser. No. 751,607, Aug. 21, 1991, abandoned, which is a continuation of Ser. No. 427,050, Oct. 26, 1989, abandoned.

[51] Int. Cl.[5] ..... A43B 7/16

[52] U.S. Cl. ..... 36/93; 36/89; 36/71; 36/119

[58] Field of Search ..... 36/88, 89, 93, 71, 119, 36/97, 117, 118, 132, 136, 55, 115

[56] References Cited

U.S. PATENT DOCUMENTS

| | | | |
|---|---|---|---|
| 3,237,319 | 3/1966 | Hanson . | |
| 3,330,444 | 7/1967 | Baypholtz . | |
| 3,581,412 | 6/1971 | Dalebout . | |
| 3,685,176 | 8/1972 | Rudy . | |
| 3,736,612 | 6/1973 | Check et al. . | |
| 3,750,310 | 8/1973 | Messner et al. . | |
| 3,769,392 | 10/1973 | Tessaro . | |
| 3,786,580 | 1/1974 | Dalebout . | |
| 3,834,044 | 9/1974 | McAusland et al. . | |
| 3,848,286 | 11/1974 | Kahmann . | |
| 3,848,287 | 11/1974 | Simonsen . | |
| 3,876,746 | 4/1975 | Hanson . | |
| 4,019,266 | 4/1977 | Hanson et al. . | |
| 4,078,322 | 3/1978 | Dalebout . | |
| 4,083,127 | 4/1978 | Hanson | 36/93 |
| 4,108,928 | 8/1978 | Swan, Jr. . | |
| 4,120,064 | 10/1978 | Salomon . | |
| 4,182,056 | 1/1980 | Dalebout . | |
| 4,301,564 | 11/1981 | Dalebout . | |
| 4,662,087 | 5/1987 | Beuch | 36/93 |
| 4,712,316 | 12/1987 | Baggio . | |
| 4,724,627 | 2/1988 | Sisco | 36/93 |
| 4,744,157 | 5/1988 | Dubner | 36/93 |
| 4,809,379 | 3/1989 | Jungwirth | 36/93 |
| 4,837,884 | 6/1989 | Hilgarth . | |

FOREIGN PATENT DOCUMENTS

| | | |
|---|---|---|
| 2106667 | 4/1972 | Fed. Rep. of Germany . |
| 2144825 | 3/1973 | Fed. Rep. of Germany . |
| 2323417 | 11/1974 | Fed. Rep. of Germany . |
| 2456612 | 6/1975 | Fed. Rep. of Germany . |
| 2456754 | 6/1975 | Fed. Rep. of Germany . |
| 2702271 | 7/1977 | Fed. Rep. of Germany . |
| 2845824 | 5/1979 | Fed. Rep. of Germany . |

*Primary Examiner*—Paul T. Sewell
*Assistant Examiner*—Thomas P. Hilliard
*Attorney, Agent, or Firm*—Ralph W. Selitto, Jr.

[57] ABSTRACT

In the custom-fitting of athletic footwear, such as ski boots and hockey skates, which include an outer shell and an inner bladder, a patch is provided between the shell and the bladder at a selected location where there is a poor fit between the shell and a wearer's foot. The patch forms a receptacle which can be inflated or otherwise supplied with a filler, such as foam, to an extent sufficient to improve the fit at the selected location.

19 Claims, 2 Drawing Sheets

26
30
32
34
28
36
14
24
16
10
12

METHOD FOR CUSTOM-FITTING BOOTS BY PROVIDING ATTACHMENTS THERETO OR TO AN INNER LINER THEREFOR

This is a continuation, of application Ser. No. 07/751,607, filed Aug. 21, 1991, now abandoned which is a continuation application of prior application Ser. No. 07/427,050, filed on Oct. 26, 1989, now abandoned.

FIELD OF THE INVENTION

The present invention relates to a method and apparatus for custom-fitting ski boots, hockey skates and the like, and, more particularly, to such a method and apparatus which are especially adapted to carry out a custom-fitting operation in situ.

BACKGROUND OF THE INVENTION

Ski boots, hockey skates and the like are commonly provided with bladders which are similar to thickly padded socks. Such bladders are usually of a unilayer construction and are worn under the shell of the boots, skates or the like. The bladder is intended to prevent shifting of the wearer's foot inside the shell, hence reducing the abrasion of the shell on the foot and thereby providing greater comfort to the wearer. Typically, the area for which comfort is the most difficult and most critical to attain is that about the ankle. Since the bladder and shell cannot be mass produced in a manner which will fit everyone equally well, various different techniques have, in the past, been developed for custom-fitting ski-boots, hockey skates and the like after their manufacture.

One such prior technique requires the wearer to affix self-adhesive foam pads directly to the bladder exterior. This method suffers from the disadvantage that it is very time-consuming to attain a comfortable fit. It is also very difficult for the manufacturer to pre-determine in what thicknesses the foam padding should be provided.

Another prior technique involves the provision of a ladder having a special two-layer construction. The area between the layers forms a reservoir into which is blown a two-part foam. One disadvantage of this technique is that too much foam can be delivered to areas in which it is not required. Further, once the foam has cured, it is difficult and painful to break in the boot, skate or the like. Additionally, this technique requires radical modification of the bladder to hold the foam.

SUMMARY OF THE INVENTION

The problems and disadvantages of the prior art described above are overcome in accordance with the present invention by providing a receptacle between an outer shell and an inner bladder of ski boots, hockey skates and the like. More particularly, the receptacle is positioned at a selected location where there is a poor fit between the shell and a wearer's foot. A filler is supplied to the receptacle to thereby improve the fit at the selected location.

In accordance with one embodiment of the present invention, the receptacle is formed by adhesively and removably attaching an expandable patch to the bladder. Alternatively, the patch can be attached to the shell rather than to the bladder. In either case, the resulting receptacle is adapted to receive the filler, such as a urethane or similar foam, from a dispenser located externally of the shell and the bladder. This filling process is advantageously carried out in situ (i.e., with the wearer's foot inserted in the bladder which, in turn, is inserted in the shell).

BRIEF DESCRIPTION OF THE DRAWINGS

For a more complete understanding of the present invention, reference may be had to the following detailed description of two exemplary embodiments considered in conjunction with the accompanying drawings, in which.

DESCRIPTION OF THE EXEMPLARY EMBODIMENTS

Although the present invention is applicable to many different types of athletic footwear which comprise an outer shell and an inner bladder, it is especially suitable for use in connection with ski boots. Accordingly, the present invention will be described below in connection with a ski boot.

Figure 1:
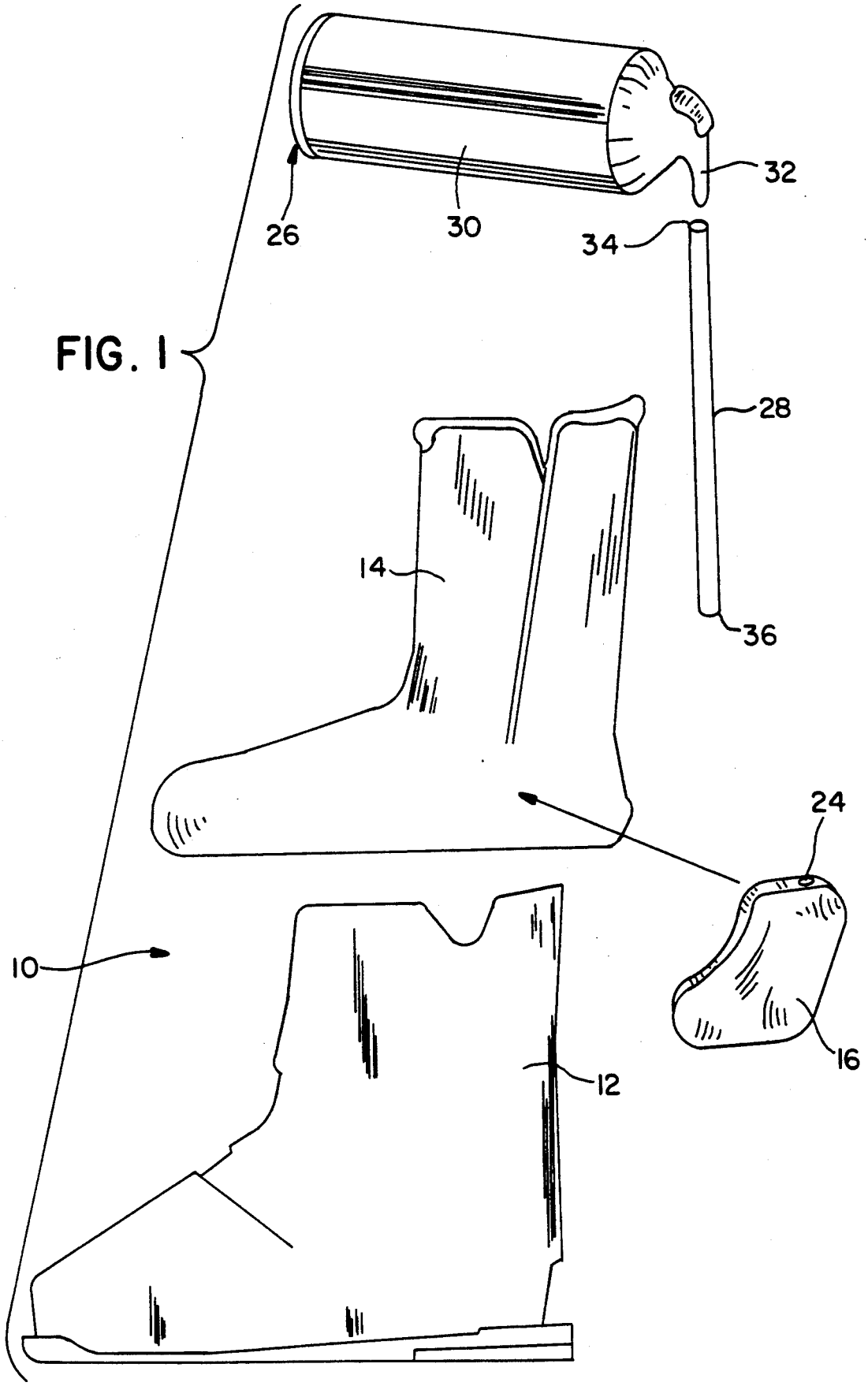
FIG. 1 is an exploded view of a ski boot and various accessories used for custom-fitting the ski boot in accordance with one exemplary embodiment of the present invention.
Figure 2:
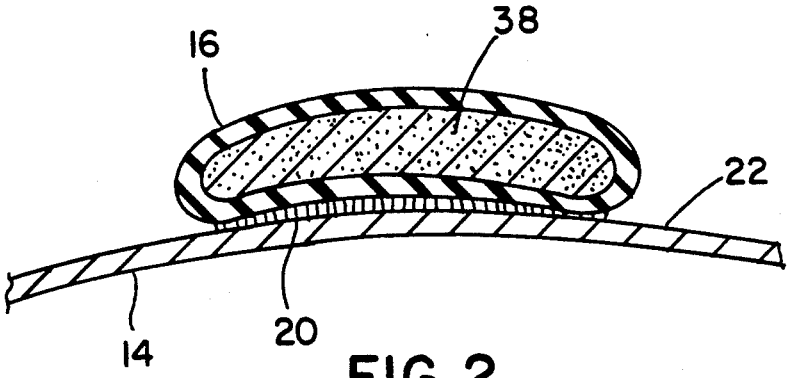
FIG. 2 is a cross-sectional view of one type of patch which can be utilized in connection with the performance of the present invention.
Figure 3:
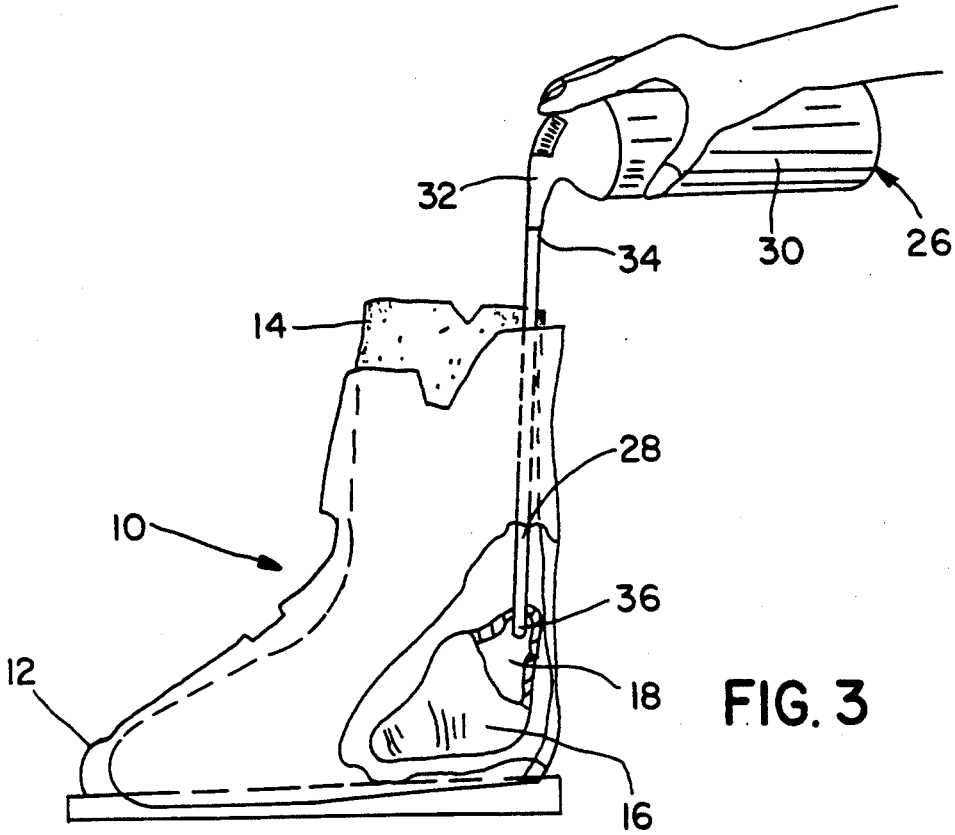
FIG. 3 is an elevational view of a ski boot being custom-fitted in accordance with the present invention, portions being broken away for purposes of clarity.

Referring to FIGS. 1-3, a ski boot 10 includes an outer shell 12 and an inner bladder 14. The outer shell 12, which is made from slightly flexible, shock-resistant plastic, has the general appearance of conventional footwear meant for use in adverse weather conditions, but is sufficiently rigid to give the support required of it in skiing. The outer shell 12 is fastened about the wearer's foot by means of any conventional mechanism (not shown), but the rigidity of the outer shell 12 prevents the wearer from being able to make fine adjustments to the fit of the shell 12 on his or her foot. Therefore, the bladder 14, which is made from a flexible, cushiony material, is generally employed to make the fit of the outer shell 12 of the ski boot 10 more comfortable, particularly about the ankle region.

A kidney-shaped patch 16, which is made from a material that is expandable and is impermeable to blown foams such as urethane, defines a self-contained reservoir 18 (see FIG. 3). One side of the patch 16 is provided with an adhesive layer 20 adapted to removably affix the patch 16 to an exterior surface 22 (see FIG. 2) of the bladder 14. The patch 16 is also provided with an inlet 24 for a purpose which will be described hereinafter.

With reference to FIGS. 1 and 3, there is provided a dispenser 26 of a suitable filler, such as urethane foam or the like, and an extension tube 28. The dispenser 26 includes a storage cannister 30 and a dispensing nozzle 32. The extension tube 28 is sized and shaped such that one end 34 be applied to the nozzle 32 of the dispenser 26 and its opposite end 36 can be inserted into the inlet 24 in the patch 16 after the patch 16 has been applied to the bladder 14 in accordance with the performance of the method to be described hereinafter.

In carrying out the method referred to above, a skier who is wearing the boot 10 first determines those locations between the bladder 14 and the shell 12 which require additional cushioning. After the skier removes his or her foot together with the bladder 14 from the shell 12, the patch 16 is applied to the exterior surface 22 of the bladder 14 at one of the preselected locations. If there is more than one such location, then a corresponding number of patches would be employed. Typically, the ankle area is the area that most often needs the immobilization and cushioning effects afforded by the present invention. However, other areas may require similar immobilization and cushioning using patches having sizes and shapes which are different from those of the patch 16.

Once the patch 16 has been applied to the bladder 14, the end 36 of the extension tube 28 is inserted into the inlet 24 of the patch 16. The skier then inserts his or her foot and the bladder 14 back into the shell 12 in such a manner that the end 34 of the extension tube 28 protrudes above the boot 10. The nozzle 32 of the dispenser 26 is then connected to the protruding end 34 of the extension tube 28 and the dispenser 26 is actuated, thereby filling or inflating the patch 16 with foam 38 (see FIG. 2). Next, the extension tube 28 is removed from the inlet 24 of the bladder 14 and finally from the boot 10 itself.

The skier wears the boot 10 until the foam 38 cures, but is able to continue with his or her activities during the curing period, which typically would be in a range of from about 5 minutes to about 30 minutes. Once the foam 38 has cured to a sufficient extent, the skier can remove the boot 10, if he or she so desires.

Figure 4:
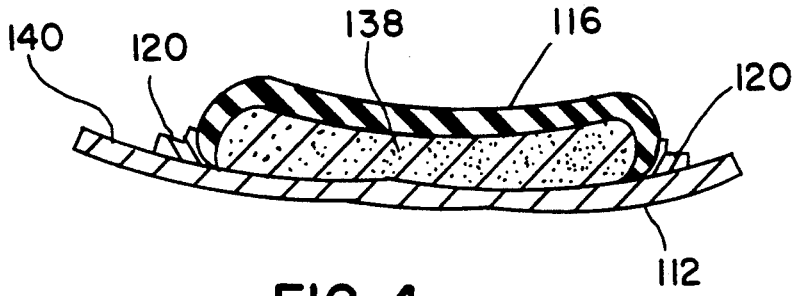
FIG. 4 is a cross-sectional view of another type of patch which can be utilized in connection with the performance of the present invention.

Elements illustrated in FIG. 4 which correspond to the elements described above with respect to FIGS. 1-3 have been designated with corresponding reference numerals increased by a hundred. The embodiment of FIG. 4 operates in the same manner as the embodiment of FIGS. 1-3 unless it is otherwise stated.

Referring to FIG. 4, a patch 116 is affixed to an interior surface 140 of a shell 112 by an adhesive strip 120 extending around the peripheral edges of the patch 116. Thus, foam 138 is contained in a confined area between the patch 116 and the bladder 114. By modifying the shape of the patch 116 prior to its application to the shell 112, the extent of the confined area can be adjusted. An inlet (not shown) provided in the patch 116 permits the insertion of an extension tube (not shown). Alternatively, the extension tube may be adapted to puncture the patch 116, in which case the patch 116 would not have to be provided with any pre-existing inlet.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. An in situ method for custom-fitting ski boots and hockey skates, which include a pair of shoe-like components, one being an outer shell and another being an inner bladder sized and shaped so as to be insertable into and removable from said shell, said bladder at least partially occupying a space existing between said shell and a wearer's foot when the wearer's foot is inserted into said bladder and said bladder is inserted into said shell, said method comprising the steps of inserting said bladder into said shell; inserting a wearer's foot into said bladder, either before or after said bladder is inserted into said shell; examining the entirety of said space between said shell and the wearer's foot so as to locate any and all sites where said bladder does not provide an adequate fit between said shell and the wearer's foot and so as to ascertain the size and shape of each of said sites where a better fit is deemed desirable; providing an empty receptacle for each of said sites where a better fit is deemed desirable, each receptacle having a size and shape which generally match the size and shape of a corresponding one of said sites where a better fit is deemed desirable; removing said bladder from said shell; selectively and removably attaching each receptacle to one of said components at its said corresponding one of said sites such that said receptacle will be positioned between said shell and said bladder when said bladder is reinserted into said shell and such that a filler supplied to said receptacle is confined to said corresponding one of said sites; supplying a filler to each receptacle while the wearer's foot is in said bladder and after said bladder has been reinserted into said shell; and allowing said filler to cure and become non-flowable within each receptacle to thereby improve the fit at each of said sites where a better fit is deemed desirable.

2. A method according to claim 1, wherein said receptacle is provided by attaching a patch to said bladder.

3. A method according to claim 2, wherein said receptacle is contained within said patch.

4. A method according to claim 2, wherein said receptacle is formed between said patch and said bladder.

5. A method according to claim 4, further comprising the step of modifying the shape of said patch prior to its attachment to said bladder.

6. A method according to claim 2, wherein said patch is adhesively attached to said bladder.

7. A method according to claim 2, wherein said patch is made from an expandable material, whereby said receptacle becomes inflated as said filler is supplied thereto.

8. A method according to claim 1, wherein said receptacle is provided by attaching a patch to said shell.

9. A method according to claim 8, wherein said receptacle is contained within said patch.

10. A method according to claim 8, wherein said receptacle is formed between said patch and said shell.

11. A method according to claim 10, further comprising the step of modifying the shape of said patch prior to its attachment to said shell.

12. A method according to claim 8, wherein said patch is adhesively attached to said shell.

13. A method according to claim 8, wherein said patch is made from an expandable material, whereby said receptacle becomes inflated as said filler is supplied thereto.

14. A method according to claim 1, wherein said filler is a foam.

15. A method according to claim 14, wherein said foam is supplied to said receptacle from a source located externally of said shell and said bladder.

16. A method according to claim 15, wherein said foam is supplied to said receptacle from said source through a conduit communicating between said receptacle and said source.

17. A method according to claim 14, wherein the wearer's foot is maintained in said bladder for a length of time sufficient to permit said foam to cure.

18. A method according to claim 14, wherein said foam is urethane.

19. A method according to claim 1, wherein said attaching means involves the selective and removable attachment of a plurality of receptacles, whereby said method improves the fit at a plurality of different sites.

* * * * *